US005879205A

United States Patent [19]

Egenolf et al.

[11] Patent Number: 5,879,205

[45] Date of Patent: Mar. 9, 1999

[54] STAMPED AND FORMED ELECTRICAL CONTACT

[75] Inventors: Bernhard Egenolf, Dreieich; Gheorghe Hotea, Griesheim, both of Germany

[73] Assignee: The Whitaker Corporation, Wilmington, Del.

[21] Appl. No.: 817,251

[22] PCT Filed: Oct. 17, 1995

[86] PCT No.: PCT/IB95/00881

§ 371 Date: Apr. 7, 1997

§ 102(e) Date: Apr. 7, 1997

[87] PCT Pub. No.: WO96/13082

PCT Pub. Date: May 2, 1996

[30] Foreign Application Priority Data

Oct. 24, 1994 [GB] United Kingdom ..... 9421358

[51] Int. Cl.[6] ..... H01R 13/00

[52] U.S. Cl. ..... 439/852; 29/882

[58] Field of Search ..... 439/852, 843, 439/851, 744, 842, 746; 29/882, 884, 874, 747, 753, 885

[56] References Cited

U.S. PATENT DOCUMENTS

| | | | |
|---|---|---|---|
| 4,466,689 | 8/1984 | Davis et al. | 29/882 |
| 4,752,254 | 6/1988 | Inoue et al. | 439/856 |
| 4,790,777 | 12/1988 | Iimori et al. | 439/744 |
| 4,952,178 | 8/1990 | Beer | 439/856 |
| 4,979,915 | 12/1990 | Pitts | 439/851 |
| 5,281,175 | 1/1994 | Chupak et al. | 439/839 |

FOREIGN PATENT DOCUMENTS

| | | | |
|---|---|---|---|
| 0 608 836-A2 | 8/1994 | European Pat. Off. | H01R 13/115 |
| 2 703 520 | 10/1994 | France | H01R 13/514 |

*Primary Examiner*—Gary Paumen
*Assistant Examiner*—Tho Dac Ta
*Attorney, Agent, or Firm*—Driscoll A. Nina

[57] ABSTRACT

An electrical contact portion having a box portion about a central axis and joined together along a seam by a mechanical interlocking portion, the contact being characterized in that a port is formed in a wall of the box to provide access by a support member to the interior of the box in order to support the seam at the interlocking portion during forming. An electrical contact having a contact portion with a contact arm between forwardly extending walls for receiving and engaging a mating terminal (not shown), where the contact portion includes a retention shoulder disposed over a contact arm that is engageable to retain the contact within a connector housing, characterized in that the retention shoulder is a rear edge of a tab formed integrally and folded over from one of the sides, a portion of which is partially separated therefrom along a slit and pressed inward so that the tab is moved closer to the opposing wall.

10 Claims, 1 Drawing Sheet

STAMPED AND FORMED ELECTRICAL CONTACT

BACKGROUND OF THE INVENTION

1. Field of the Invention

This invention relates to electrical terminals and, in particular, to electrical terminals having a contact portion formed from a single blank of material.

2. Summary of the Prior Art

It is known in the industry to form electrical contacts from a single blank of material. When these contacts include a enclosed box portion, there is at least one seam that must be joined together to maintain the structural integrity of the box. One way of accomplishing this is to laser weld a number of places along the box. A problem with this is that laser welding is relatively slow in relation to the stamping and forming processes being applied to the manufacture of the contact. Another problem is that the laser welding equipment involves a large capital expense. Therefore, it has been discovered that it is possible to join the seam together by way of interlocking mechanical features formed therealong. These features may take on the form of a dove-tail type joint or the rounded meandering similar to the keys on pieces of a jigsaw puzzle.

In order to join the complementary mechanical features together along the seam, it is necessary to support the walls which incorporate these mechanical features from the inside of the box portion. This is typically accomplished by inserting a support member into either of the open ends about which the box shell has been formed. A problem with this exists where the simultaneous stamping and forming processes result in contact structure that blocks the ends of the box or the structure is not sufficiently large that a robust pin may be inserted therein. Therefore, what is necessary is to provide support to the underside of the seams corresponding to the mechanical interlocking portions without needing access through the open ends of the box portion.

Another problem that occurs in stamping and forming a single blank of material to form a contact portion of an electrical terminal is that it is necessary in some designs to have certain features overlie another feature. This is typically accomplished by the design layout of the blank of material. However, in some cases it is impossible to form the desired feature in such a way that it overlaps the other component. What is needed is a way to overlie one component with another feature of a one piece contact.

SUMMARY OF THE INVENTION

It is an object of this invention to provide access to the underside of the interlocking portion of the seam of a contact box portion formed about axis 1, so that the seam may be supported during formation of the box to assure that the contact box walls are interlocked.

This object is accomplished by providing an access port in a wall of the contact box portion which enables a support member to be disposed beneath the interlocking portion of the seam of the box.

It is another object to provide a feature that overlies another component of the contact.

This object is accomplished by providing a slit along the contact that enables the material on one side of the slit to be offset relative to the material on the other side of the slit, thereby enabling a feature attached to the offset side of the slit to be moved over another part of the contact.

DETAILED DESCRIPTION OF THE PREFERRED EMBODIMENT

Figure 1:
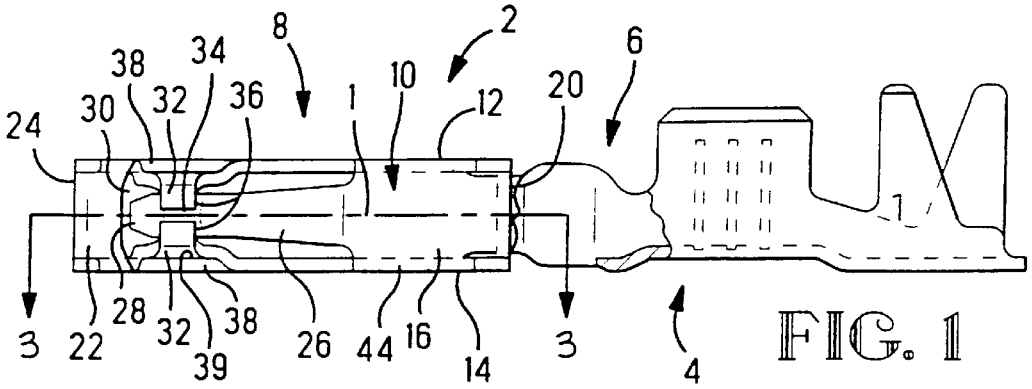
FIG. 1 is a side view of an electrical contact according to the present invention.

With reference first to FIG. 1, an electrical contact according to the present invention is shown generally at 2. The contact 2 includes a conductor engaging portion 4 advantageously shown to be crimpable upon a wire lead. The conductor engaging portion 4 may take on other forms as desired. The conductor engaging portion 4 is interconnected, by an intermediate portion 6, to the contact portion 8 that is adapted to receive a tab or pin terminal (not shown) therein.

Figure 2:
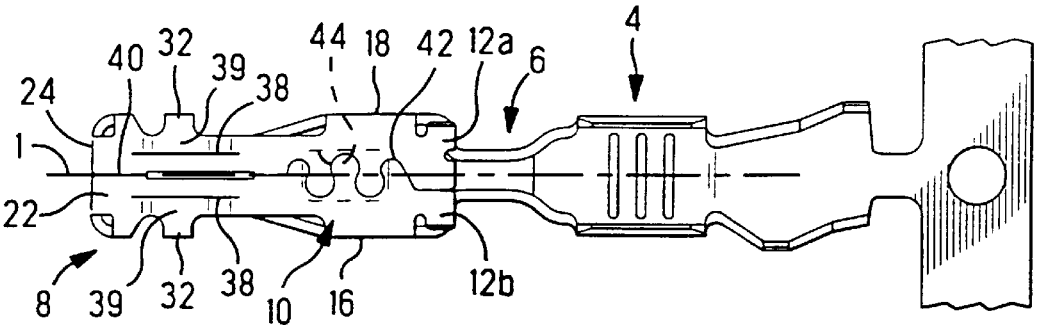
FIG. 2 is a top view of the electrical contact of FIG. 1.

The contact portion 8 includes a box section 10 formed of a top 12, a bottom 14, and side walls 16 and 18 (FIG. 2). The box section 10 is illustrated as a rectangular shell portion having a hollow interior. It would also be possible to have a cylindrical box section or a box section of another desirable form. The invention is not intended to be limited to a rectangular form.

Furthermore, the contact box section 10 includes an end flap 20 that acts to separate the functions of the contact portion 8 from the intermediate portion 6 and conductor engaging portion 4 by preventing over-insertion of a pin into the contact portion, over insertion of the wire lead (not shown) inserted into the conductor engaging portion 4, or to prevent by-products of soldering a lead to the conductor engaging portions 4 from entering the contact portion 8. The end flap 20 is folded downward from the top 12 or upward from the bottom 14 to block entrance to the rear open end of the box section 10.

Opposite the end flap 20 is pin receiving portion 22 at the front end 24 of the contact portion 8. The pin receiving portion 22 is supported by the top 12 and bottom 14 of the box section 10. Extending forwardly from the sides 16,18 of the box portion, are cantilevered contact arms 26 that extend forwardly to a free end 28. The free end 28 is supported by a tongue 30 formed by a portion of the end receiving portion 22, best seen in FIG. 3.

In order to provide contact retention within a connector housing, it is common to form a shoulder which can be engaged by part of the connector housing or a secondary locking member cooperating therewith. In some cases it is necessary that the shoulder be formed on the same side of the contact as the contact arms, such as in this case. It is also occasionally necessary that the shoulder exist over the contact arms. In order to accomplish this, tabs 32 are formed in each of the top and bottom walls 12,14. These tabs 32 are then folded over into the open part of side walls 16,18. However, due to the flat sheet layout of the contact blank (not shown), there is a significant gap between facing tabs 32. In order to reduce the gap 34 between the tabs 32, such that rearward edges 36 of each of the tabs combine to form a shoulder surface engageable by some part of the connector housing, slits 38 are formed in the extensions of the bottom and top walls 14,12. Portions 39 of the wall on one side of the slits are then displaced inwards toward each other such that the gap 34 is reduced while leaving the portions 39 a unitary part of the walls from which they are formed, thereby eliminating sharp edges and corners which may lead to assembly or operational difficulties. In the illustrative example shown in the drawings, tabs 32 overlie a contact arm 26 to form a shoulder. It would also be possible to have the tabs underlie a feature depending on the desired outcome.

Figure 3:
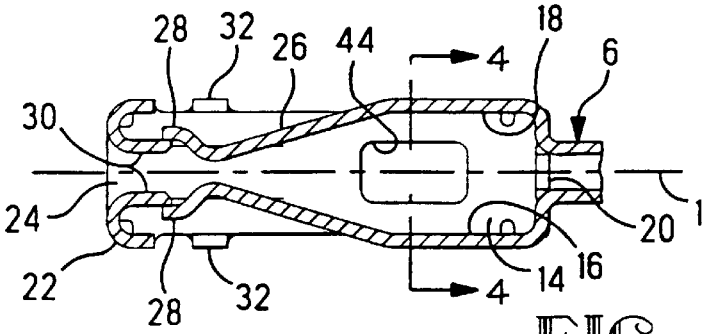
FIG. 3 is a cut-away top view taken along line 3—3 of the electrical contact of FIG. 1.

With reference now to FIG. 2 and FIG. 3, in order to provide the structural integrity necessary to generate the proper contacting force on a mating contact and to assure rigidity to the contact 2 during assembly, it is necessary to join the side edges of the single blank of material used together along seam 40. Seam 40 includes an interlocking portion 42. This interlocking portion 42 is a meandering profile similar to that of a jigsaw puzzle that, once opposing profiles 42*a* 42*b* are interlocked, prevents separation of the seam 40. In order to provide support to the interlocking portion 42 during the forming process, a port 44 is formed in one of the box section 10 walls. In this embodiment, the port 44 has advantageously been formed in the opposite bottom wall 14. It would be possible to incorporate the port into other walls if desired.

Figure 4:
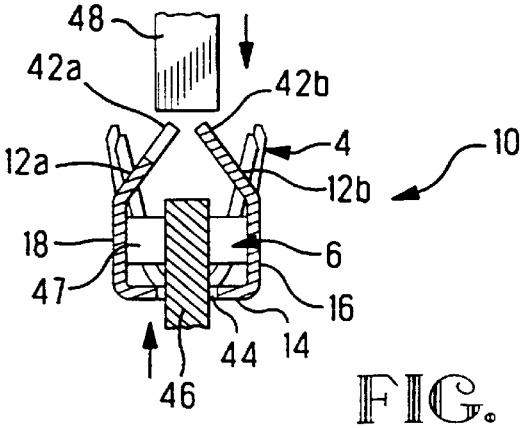
FIG. 4 is a sectional view of the assembly of the box of the terminal of FIG. 1 taken at line 4—4 of FIG. 3.

With reference now to FIG. 4, the port 44 formed in the bottom 14 of the box section 10 is made large enough to receive a support member 46 therethrough. The support member 46 extends into the open portion of the box 47 to a point just below where it is desired to have the top wall 12 formed. The top wall 12 is made up of two wall segments 12*a*,12*b*. Typically, one of the wall segments would be brought down against the support member 46 by a forming member 48 slightly before its counterpart wall segment 12*a*, such that opposing profiles 42*a*, 42*b*, are the interlocking portion 42 of the seam 40 may interlock with each other. Once the interlocking portion 42 of the seam 40 is closed, the support member 46 may be removed from the port 44 and the box-section 10 of the contact 2 will maintain its structural integrity.

Advantageously, the present invention provides for joining the seam of an electrical contact box portion by mechanical means where it is not possible to insert a support member longitudinally through the box. It is another advantage of this invention, that by joining the seam mechanically, the contact may be produced in an economical efficient manner. It is an advantage of forming the slits in the contact walls, whereby a feature may be brought over a corresponding feature, in order to save material required to manufacture a particular contact. It is important to note that while this invention is being described as overlying a portion of the contact, it could just as easily apply to underlying a portion of the contact.

We claim:

1. An electrical contact portion, comprising a box portion formed about a central axis and joined together along a seam by mechanical interlocking portions to produce a shell-like structure with an hollow interior, the contact portion being characterized in that a port is formed in a wall of the box that is opposite the seam to provide access for a support member to the interior of the box transverse to the central axis in order to properly seal the interlocking portions during forming.

2. The electrical contact portion of claim 1, further characterized in that the port is disposed directly opposite the interlocking portions of the seam.

3. The electrical contact portion of claim 1 or claim 2, further characterized in that the box has four sides with the interlocking portions of the seam disposed centrally within one of the sides.

4. The electrical connector portion of claim 1, further characterized in that the interlocking portions include a meander.

5. A method of forming an electrical contact comprising the steps of forming a flat contact blank having a port therein and mechanical interlocking features therealong;

folding the flat contact bank into a box shape and inserting a support member through the port into the box shape in order to support the interlocking features as the box is closed and the features are joined together.

6. An electrical contact comprising a contact portion for receiving and engaging a mating terminal and including a contact arm disposed between two opposing walls, there the contact portion further includes a retention shoulder for retaining the contact within a connector housing, characterized in that one of the opposing walls includes a wall portion from which an integrally formed tab extends and is folded-over towards the other one of the opposing walls where the retention shoulder is a rear edge of the tab, the portion of the wall being partially separated from the wall along a slit while remaining joined to the wall at opposite ends where the wall portion is pressed inward so that the tab is moved closer the opposing wall.

7. The electrical contact of claim 6, further characterized in that the contact portion includes a second tab extending in a similar fashion as the other tab from the other wall brought towards each other.

8. The electrical contact of claim 6 or claim 7, further characterized in that the contact portion includes two pairs of tabs forming two separate shoulders.

9. The electrical contact of claim 6, further characterized in that the tabs overlie the contact arm.

10. The electrical contact of claim 6, further characterized in that a box shaped pin receiving portion is at a forward end of the contact.

* * * * *